US011069183B2

(12) United States Patent
Nelson et al.

(10) Patent No.: US 11,069,183 B2
(45) Date of Patent: Jul. 20, 2021

(54) ELECTRONIC GAMING MACHINE WITH MULTIPLE CARD READERS TO ENABLE MULTIPLE PLAYER ACCOUNT CAPABILITIES

(71) Applicant: IGT, Las Vegas, NV (US)

(72) Inventors: Dwayne Nelson, Las Vegas, NV (US); Kevin Higgins, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/577,832

(22) Filed: Sep. 20, 2019

(65) Prior Publication Data

US 2021/0090384 A1 Mar. 25, 2021

(51) Int. Cl.
*G07F 17/32* (2006.01)
*G07F 17/34* (2006.01)

(52) U.S. Cl.
CPC ..... *G07F 17/3223* (2013.01); *G07F 17/323* (2013.01); *G07F 17/3244* (2013.01); *G07F 17/34* (2013.01)

(58) Field of Classification Search
USPC ..... 463/20
See application file for complete search history.

(56) References Cited

U.S. PATENT DOCUMENTS 8,147,334 B2 4/2012 Gatto et al.
8,764,566 B2 7/2014 Miltenberger et al.
10,748,381 B2 * 8/2020 LeStrange ..... G06Q 20/40
2008/0045305 A1 * 2/2008 Okada ..... G07F 17/34 463/20
2011/0269527 A1 * 11/2011 Okada ..... G07F 17/32 463/20
2013/0310183 A1 * 11/2013 Gagner ..... G07F 17/3202 463/43
2015/0141125 A1 * 5/2015 LeStrange ..... G07F 17/3223 463/25
2019/0066441 A1 * 2/2019 LeStrange ..... G06Q 20/04
2021/0027579 A1 * 1/2021 LeStrange ..... G07F 7/08

* cited by examiner

*Primary Examiner* — Pierre E Elisca
(74) *Attorney, Agent, or Firm* — Sheridan Ross P.C.

(57) ABSTRACT

The present disclosure relates generally to gaming machines, systems, and methods. As an example, a method is disclosed that includes registering a first card read event at a first card reader; in response to registering the first card read event, extracting, with a processor, first card data that includes a first player identification number in a first player identification number format; registering a second card read event at a second card reader; in response to registering the second card read event at the second card reader, extracting, with the processor, second card data that includes a second player identification number in a second player identification number format; enabling, with the processor, a player to login to a first game management system; and providing, with the processor, the second card data to a second communication interface to enable the player to login to a second game management system.

20 Claims, 10 Drawing Sheets

ELECTRONIC GAMING MACHINE WITH MULTIPLE CARD READERS TO ENABLE MULTIPLE PLAYER ACCOUNT CAPABILITIES

BACKGROUND

The present disclosure is generally directed to gaming machines and, in particular, toward gaming machines used to facilitate user interactions with multiple different game management systems.

Electronic gaming machines (EGMs) traditionally facilitated gameplay with a single game, such as video poker, a slot game, keno, or the like. As EGMs and networking technology in general have evolved, the management of games and gameplay on EGMs has also developed. For instance, game management systems have been developed to track player activity at one or multiple different EGMs in a casino. Such game management systems also enable player tracking across multiple casinos or, in some instances, facilitate loyalty opportunities for a player that frequents a casino often or plays a particular type of game at an EGM on more than one occasion.

Other developments in the casino environment include the expansion of sports wager products onto the casino floor. For instance, some EGMs are now being equipped with functionality that enables a player to place or track sports wagers at an EGM while also playing the native game offered by the EGM (e.g., video poker, slot game, keno, etc.). To provide this functionality, the EGM needs to be in communication with a sports wagering system in addition to being in communication with the game management system used by the casino to track player activity with respect to the native game offered by the EGM.

While physically connecting an EGM to two different systems is relatively straight forward, there are complications at other levels of the network stack. For instance, the two different systems rarely or never utilize the same communication protocol to track player activity. Changing protocols or convincing one system to adopt the protocol of another system is time consuming, expensive, and, in some instances, nearly impossible.

BRIEF SUMMARY

In certain embodiments, the present disclosure relates to an electronic gaming machine, a system, and a method. In some embodiments, an electronic gaming machine is provided, comprising: a first communication interface that enables communications via a first communication protocol with a first game management system, where the first game management system tracks first player activity; a second communication interface that enables communications via a second communication protocol with a second game management system, where the second game management system tracks second player activity; a first card reader; a second card reader; a processor coupled to the first card reader, the second card reader, the first communication interface, and the second communication interface; and a computer-readable storage medium, coupled with the processor and comprising instructions stored thereon that are executable by the processor, where the instructions include: a set of instructions that register a first card read event at the first card reader and, in response to registering the first card read event, extract first card data that includes a first player identification number in a first player identification number format; a set of instructions that register a second card read event at the second card reader and, in response to registering the second card read event, extract second card data that includes a second player identification number in a second player identification number format; a set of instructions enable a player to login to the first game management system in response to registering the first card read event; and a set of instructions that provide the second card data to the second communication interface to enable the player to login to the second game management system.

In some embodiments, a system is provided, comprising: a first game management system that tracks first player activity; a second game management system that tracks second player activity; and an electronic gaming machine that communicates with the first game management system and the second game management system, where the electronic gaming machine comprises: a first communication interface that enables communications with the first game management system; a second communication interface that enables communications with the second game management system; a first card reader; a second card reader; a processor coupled to the first card reader, the second card reader, the first communication interface, and the second communication interface; and a computer-readable storage medium, coupled with the processor and comprising instructions stored thereon that are executable by the processor, where the instructions include: a set of instructions that receive first card data from the first card reader that includes a first player identification number in a first player identification number format; a set of instructions that receive second card data from the second card reader that includes a second player identification number in a second player identification number format; a set of instructions that enable a player to login to the first game management system in response to receiving the first card data; and a set of instructions that provide the second card data to the second communication interface to enable the player to login to the second game management system.

In some embodiments, a method is provided, comprising: registering a first card read event at a first card reader; in response to registering the first card read event, extracting, with a processor, first card data that includes a first player identification number in a first player identification number format; registering a second card read event at a second card reader; in response to registering the second card read event at the second card reader, extracting, with the processor, second card data that includes a second player identification number in a second player identification number format; enabling, with the processor, a player to login to a first game management system, where the first game management system tracks a first player activity; and providing, with the processor, the second card data to a second communication interface to enable the player to login to a second game management system, where the second game management system tracks a second player activity using the second player identification number format.

Additional features and advantages are described herein and will be apparent from the following Description and the figures.

DETAILED DESCRIPTION

Figure 1:
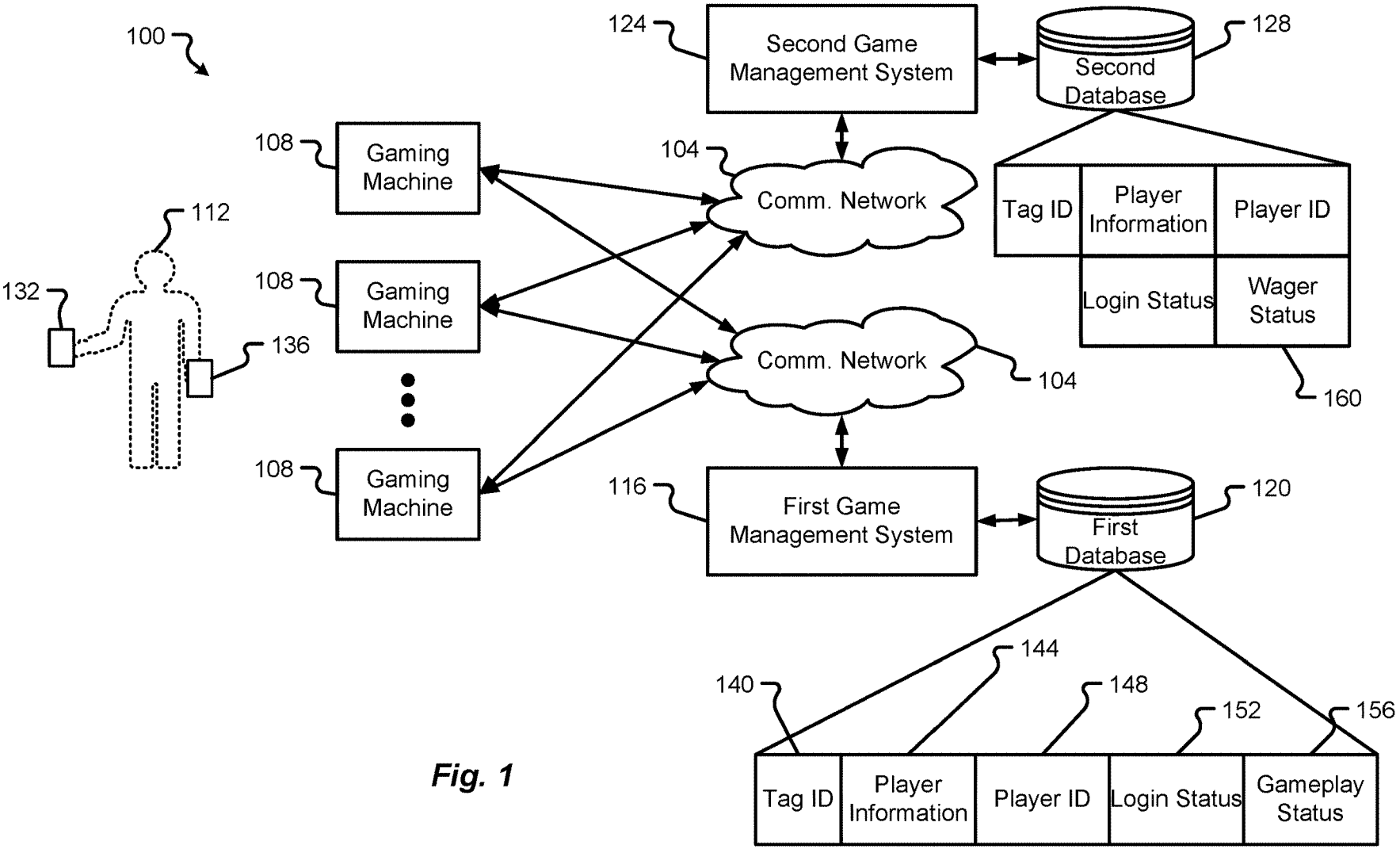
FIG. 1 is a block diagram of a system accordance with embodiments of the present disclosure.

Embodiments of the present disclosure will be described in connection with an EGM that is configured to interact with a first game management system and a second game management system. The examples of the game management systems depicted and described herein should not be construed as limiting. For instance, one example of the first game management system may correspond to a casino game management system that is used to track player activity with respect to a particular game natively offered at the EGM (e.g., video poker, slots, keno, etc.). The casino game management system, in some embodiments, may correspond to a traditional slot Player Tracking System (PTS) that allows a player to play one or more casino games at the EGM. A non-limiting example of the second game management system may correspond to a sports wagering system. In this particular situation, a player may be allowed to play a traditional casino game at the EGM while also betting and tracking bets placed on sports events (or other wagerable events). Each of the first game management system and second game management system may have its own player accounts, data formatting requirements, protocols, etc. Thus, a single player may be represented or recognized by the first game management system by a first player identification number or player ID while simultaneously begin represented or recognized by the second game management system by a second player identification number or player ID that is different from the first player identification number of player ID.

Because the first and second game management systems are so different, integration between the two systems is unlikely and it is more convenient from a deployment perspective to allow the systems operate independent of one another. The difficulty presented is to enable the EGM to work with both game management systems in a seamless way that doesn't frustrate the player experience. Aspects of the present disclosure present an EGM that is capable of interfacing with two or more game management systems without frustrating the player experience and while allowing the game management systems to operate independent of one another such that the player can be represented in each game management system under a different player ID and each game management system can continue to utilize their own data formats and communication protocols.

It is one aspect of the present disclosure to provide an EGM that is in communication with a first game management system and a second game management system as described above. In an example where the first game management system corresponds to a PTS, the EGM may include a Slot Machine Interface Board (SMIB) that includes a card reader. The SMIB is provided as a component of the EGM that enables direct communication from the card reader of the SMIB to the first game management system. In some embodiments, the SMIB may also be in communication with a processor of the EGM. In some embodiments, a Slot Accounting System (SAS) protocol may be used to facilitate communications between the SMIB and the processor of the EGM. In some embodiments, the SAS protocol between the SMIB and the processor may not necessarily provide a player card number (or player ID) to the processor when the player inserts or presents their card to the card reader of the SMIB. Rather, the SMIB may be configured to automatically, and without assistance of the processor, log the player into the first game management system without providing the player ID or card number to the EGM (or more specifically the processor of the EGM). Ideally, the SAS protocol would provide the player ID or card number to the processor, but this feature may require an adjustment to the SAS protocol, which is time consuming and expensive.

Thus, embodiments of the present disclosure further contemplate that the EGM can be provided with an additional card reader that is used in connection with the second game management system. As an example, a player may carry a first card and a second card. The first card may be presented to the card reader of the SMIB and may be used to login the player with respect to the first game management system. The second card may be presented to the additional card reader of the EGM and may be used to login the player with respect to the second game management system. While it is a slight inconvenience for the player to carry two cards in this example, the player experience is generally the same and seamless and there is no integration requirements imposed on the different game management systems or the SAS protocol. Furthermore, aspects of the present disclosure contemplate that the player may be allowed to carry a single form factor of a credential that has two "cards" that are readable by two different card readers of the EGM. The two different cards provided in a common form factor may correspond to two physically different cards or credentials that are connected together. Alternatively the two different cards may correspond to a multi-function card that is readable by the two different card readers of the EGM.

In some aspects of the present disclosure, the two different card readers of the EGM may be labeled or styled such that the player is aware of the differences between the two card readers. In some aspects of the present disclosure, the two card readers may be placed in relatively close proximity to one another such that a presentation of a single form factor of a credential having two cards enables both card readers to read each card at substantially the same time.

In some embodiments, one of the card readers may be directly connected to or integrated with the SMIB whereas the other card reader may be directly connected to the processor of the EGM. When a player presents or inserts a card into the card reader that is directly connected to or integrated with the SMIB, the SMIB may perform a player login process with the first game management system in its usual fashion. When the player presents or inserts their other card into the second card reader, the data from the card may be provided to the processor of the EGM. The processor of the EGM may then use the data from the card to login the player with the second game management system. Advantageously, the EGM enables the player to interact with multiple game management systems without requiring system integration or protocol modifications.

Gaming System

With reference initially to FIG. 1, details of an illustrative gaming system 100 will be described in accordance with at least some embodiments of the present disclosure. The components of the system 100, while depicted as having particular instruction sets and devices, are not necessarily limited to the examples depicted herein. Rather, a system according to embodiments of the present disclosure may include one, some, or all of the components depicted in the system 100 and does not necessarily have to include all of the components in a single device.

The gaming system 100 is shown to include one or more communication networks 104 that interconnect and facilitate machine-to-machine communications between one or multiple gaming machines 108 and one or more game management systems 116, 124. It should be appreciated that a communication network 104 may correspond to one or many communication networks without departing from the scope of the present disclosure. In some embodiments, the gaming machines 108 and game management systems 116, 124 may be configured to communicate using various nodes or components of a communication network 104. The communication network 104 may comprise any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may comprise a number of different communication media such as coaxial cable, copper cable/wire, fiber-optic cable, antennas for transmitting/receiving wireless messages, and combinations thereof.

In some embodiments, the gaming machines 108 may be distributed throughout a single property or premises (e.g., a single casino floor) or the gaming machines 108 may be distributed among a plurality of different properties. In a situation where the gaming machines 108 are distributed in a single property or premises, the communication network 104 may include at least some wired connections between network nodes. As a non-limiting example, the nodes of the communication network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The gaming machines 108 may utilize the same or different types of communication protocols to connect with the communication network 104. It should also be appreciated that the gaming machines 108 may or may not present the same type of game or wagering interface to a player 112. For instance, a first gaming machine 108 may correspond to a gaming machine that presents a slot game to the player 112, the second gaming machine 108 may correspond to a sports betting terminal, and other gaming machines 108 may present other types of games or a plurality of different games for selection and eventual play by a player 112. It may be possible for the some of the gaming machines 108 to communicate with one another via a communication network 104.

A gaming machine 108 may correspond to a type of device that enables player interaction in connection with making wagers, communicating, watching live competitive contests, and/or playing games of chance. For instance, the gaming machines 108 may correspond to a type of device that enables a first player 112 to interact with a second player 112 at respective gaming machines 108. In other embodiments, each player 112 may be enabled to play a game individually at a gaming machine 108.

As will be discussed in further detail herein, a player 112 may be allowed to carry a first card 132 and/or a second card 136. Although the player 112 is depicted as carrying two physically separate cards 132, 136, it should be appreciated that the player 112 may carry a single card that is readable by multiple readers of a gaming machine 108. Presentation of one or both cards 132, 136 to a gaming machine 108 may enable the player 112 to login or register their presence at a particular gaming machine 108 with respect to a first game management system 116 and/or second game management system 124. In some embodiments, a player 112 may login to the first game management system 116 by presenting the first card 132 to a gaming machine 108, which causes components of the gaming machine 108 to initiate a login process with the first game management system 116 on behalf of the player 112. Similarly, the player 112 may login to the second game management system 124 by presenting the second card 136 to the gaming machine 108, which causes components of the gaming machine 108 to initiate a separate login process with the second game management system 124 on behalf of the player 112. Additional aspects of the login process and components of the gaming machine 108 that facilitate a login process with a game management system 116, 124 will be described in further detail herein.

In some embodiments, the first game management system 116 may correspond to a system used within a casino to manage slot games, video poker games, bingo games, keno games, or the like that are played on one or more of the gaming machines 108. In some embodiments, the second game management system 124 may correspond to a system used within the casino to manage sports wagers placed by players 112 either at a sports desk or at a gaming machine 108. Although not depicted, it should be appreciated that both game management systems 116, 124 may include one or multiple servers that execute instructions in connection with managing the games or wager capabilities made available at the gaming machines 108. In some embodiments, the first game management system 116 operates independent of the second game management system 124. In some embodiments, player 112 activities registered with the first game management system 116 may not necessarily be registered with the second game management system 124. For instance, if the player 112 places a bet on a game of chance, bets a certain amount in a slot game or video poker game, plays credits in connection with a slot game or video poker game, wins during play of the game of chance, or the like, such player 112 activities may be registered by the first game management system 116 and not by the second game management system 124. Conversely, if the player 112 places a wager on a sporting event, is viewing a sporting event at a gaming machine 108, or an outcome of a particular sporting event results in the player 112 winning a previously-placed wager, then such player 112 activities may be registered by the second game management system 124 and not by the first game management system 116. As another example, if the player 112 completes a login process with the first game management system 116, the player 112 has not necessarily completed a login process with the second game management system 124 until the player 112 presents an appropriate card 136 to an appropriate reader of the gaming machine 108. The act of logging in to either the first game management system 116 or second game management system 124 may enable the player 112 to receive additional playing benefits (e.g., loyalty benefits), maintain or track wager activity, purchase additional wager or gameplay credits, and the like.

As shown in FIG. 1, the first game management system 116 may utilize one or more first databases 120 to track first player 112 activity with respect to the gaming machine 108. For instance, if the first game management system 116 corresponds to a PTS, then games played at the gaming machines 108, credits wagered in a slot game, credits won in a slot game, etc. may correspond to the types of first player 112 activities tracked by the first game management system 116. Similarly, the second game management system 124 may utilize one or more second databases 128 to track second player 112 activity with respect to the gaming machine 108. For instance, if the second game management system 124 corresponds to a sports wagering system, then wagers placed on sporting events, results of wagers placed, and games being watched at the gaming machine 108 may correspond to the types of second player 112 activities tracked by the second game management system 124. The databases 120, 128 may be used to store records for player 112 activity with respect to the designated game management system 116, 124.

The illustrative first database 120 is shown to include data fields used to track player 112 activity with respect to games of chance played at a gaming machine 108. The illustrative, but non-limiting, data fields may include a tag ID field, a player information field 144, a player ID field 148, a login status field 152, and a gameplay status field 156. The tag ID field 140 may correspond to a field used to store an identification number or string that uniquely identifies a first card 132 carried by the player 112 from among other cards used by other players. The format of the identification number or string used to uniquely identify the first card 132 may be specific to the first game management system 116 and can correspond to any alphanumeric sequence or any length (e.g., 1 bit, 2 bits, . . . N bits).

The player information field 144 may be used to store information describing a player 112 with respect to the first game management system 116. For instance, the player information field 144 may be used to store information describing whether or not the player 112 has a loyalty status with a particular casino, whether the player 112 is a VIP within the casino, historical gameplay information for the player 112 (e.g., casino visit times, durations, winnings, losses, etc.). In some embodiments, the information maintained in the player information field 144 may be unique to particular games played by the player 112 at gaming machines 108 and may describe the types of games historically played by the player 112.

The player ID field 148 may be used to store an identification number or string that uniquely identifies the player 112 from among other players. As an example, the player ID field 148 may store a player loyalty identification number and may have a particular format associated therewith (e.g., a required length, a number of bits, permissible symbols, etc.) In some embodiments, the player ID assigned to a player 112 may be uniquely assigned by a casino that administers the first game management system 116.

The login status field 152 may be used to store a current status of player 112 login with respect to the first game management system 116. For instance, the login status field 152 may indicate whether or not a player 112 is currently logged in and, if the player 112 is currently logged in, an identification of the gaming machine 108 at which the player 112 is currently logged in. The login status field 152 may also be used to store historical login information for the player 112 with respect to the first game management system 116.

The gameplay status field 156 may be used to store information describing a player's 112 gameplay status at a gaming machine 108. For instance, the gameplay status field 156 may store information describing wager history, credit in information, credit out information, duration of a gaming session with a particular gaming machine 108, and other information that is known to be tracked by the first game management system 116.

The illustrative second database 128 is also shown to include data fields used to track player 112 activity with respect to the second game management system 124. The types of information tracked by the second game management system 124 may be similar to the types of information tracked by the first game management system 116; thus, some data fields maintained in the second database 128 may be similar to the data fields maintained in the first database 120; however, the second game management system 124 may not necessarily utilize the same data formats as the first game management system 116. Therefore, the format of data maintained in the second database 128 may be different from the format of data maintained in the first database 120, even if the type of data is similar. For instance, the data format for the tag ID field in the second database 128 may be different from the data format for the tag ID field in the first database 120. Likewise, the data format for the player ID field in the second database 128 may be different from the data format for the player ID field in the first database 120.

The second database 128 is further illustrated to include different data fields from the first database 120. For instance, the second database 128 may include a wager status field 160 in the event that the second game management system 124 corresponds to a sports wagering system. The wager status field 160 may be used to store information describing wagers placed by a player 112, odds on wagers placed by the player 112, whether a wager was placed at a gaming machine 108, whether a winning wager has been paid and, if so, whether the winning wager was paid at a gaming machine 108, and any other information describing sports wagers placed by the player 112.

As mentioned above, a gaming machine 108 may include any type of known device such as a slot machine, a sports wagering terminal, an electronic table game (e.g., video poker), a skill-based game, etc. The gaming machine 108 can be in the form of an EGM, virtual gaming machine, video game gambling machine, etc.

Gaming Machine

With reference now to FIGS. 2-7, additional details of a gaming machine 108 will be described in accordance with at least some embodiments of the present disclosure. While depicted as a gaming machine 108, it should be appreciated that some or all of the components of a single gaming machine 108 may be distributed across multiple gaming machines 108 (of the same or different type) without departing from the scope of the present disclosure.

Figure 2:
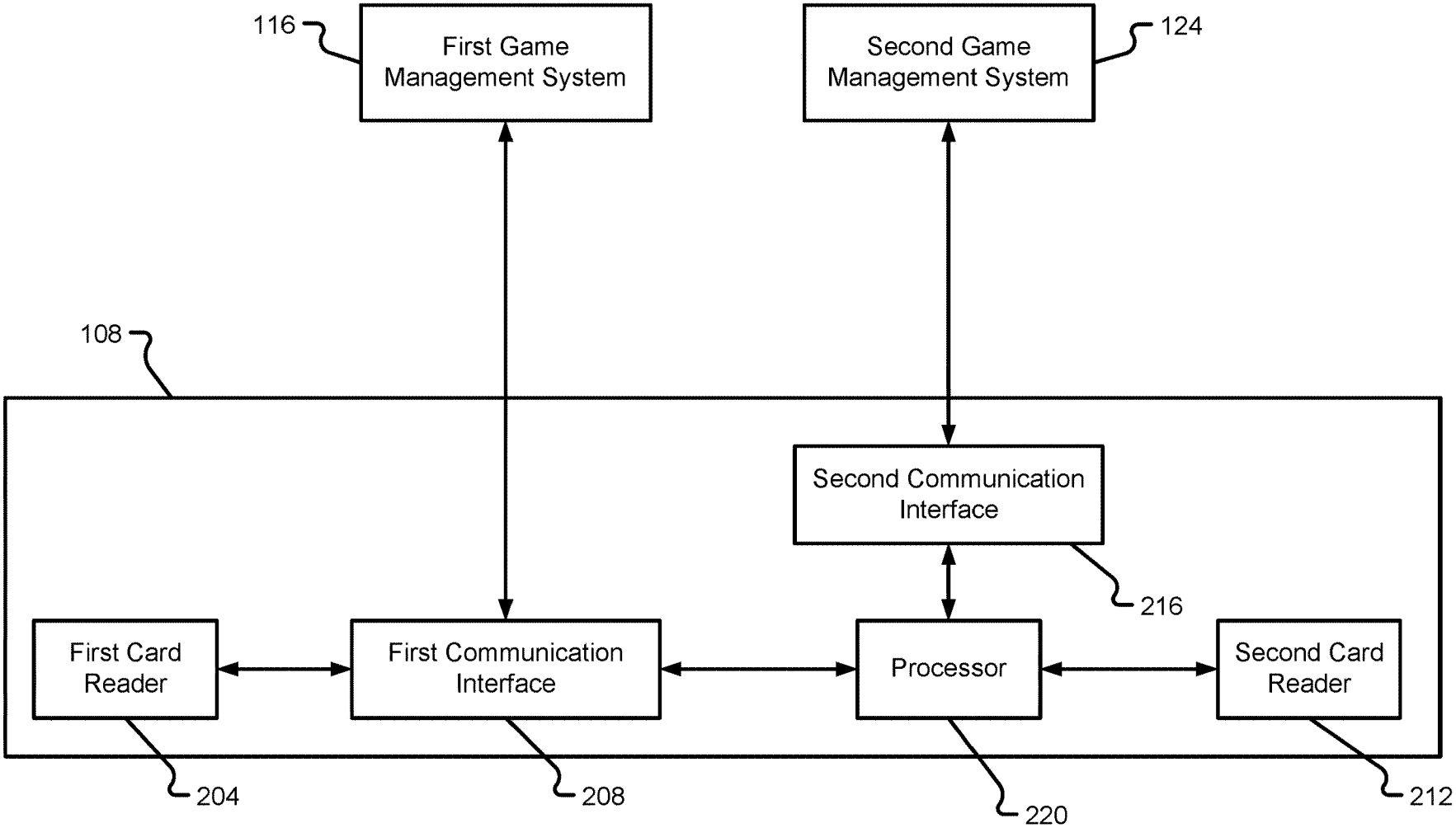
FIG. 2 is a block diagram depicting additional an illustrative system configuration in accordance with embodiments of the present disclosure.

The illustrative gaming machine 108 depicted in FIG. 2 is shown to include a first card reader 204, a first communication interface 208, a second card reader 212, a second communication interface 216, and a processor 220. In the depicted embodiment, the first card reader 204 is in direct communication with the first communication interface 208 whereas the second card reader 212 is in communication with the second communication interface 216 via the processor 220. In some embodiments, the first communication interface 208 may correspond to a component of the gaming machine 108 that has the first card reader 204 integrated therewith. As a more specific but non-limiting example, the first communication interface 208 may correspond to a SMIB and the first card reader 204 may be integrated with the SMIB. The first communication interface 208 may enable the gaming machine 108 to interact with the first game management system 116. All elements of the gaming machine 108 may be considered to be coupled to one another, regardless of whether or not such coupling is direct or indirect. For instance, the processor 220 may be considered to be coupled to the first card reader 204 via the first communication interface 208 and the second communication interface 216 may be considered coupled to the second card reader 212 via the processor 220. In other words, "coupling" as used herein does not necessarily require a direct communication between components.

In some embodiments, the second communication interface 216 may correspond to a physically separate component of the gaming machine 108 that enables the gaming machine 108 to interact with the second game management system 124. The second communication interface 216 may or may not necessarily have similar hardware as the first communication interface 208. Also, the first communication interface 208 and second communication interface 216 may utilize different communication protocols, different port types, and/or different data formatting rules to communicate with the first game management system 116 and second game management system 124 respectively.

The nature of the first communication interface 208 and/or second communication interface 216 may depend upon the protocol and/or networking requirements of the first game management system 116 and/or second game management system 124. Examples of a suitable communication interface 208, 216 include, without limitation, an Ethernet port, a USB port, an RS-232 port, an RS-485 port, a NIC, an antenna, a driver circuit, a modulator/demodulator, etc. One or both communication interfaces 208, 216 may include one or multiple different network interfaces depending upon whether one or multiple network connections are required to facilitate interactions with the first game management system 116 or second game management system 124. For instance, the gaming machine 108 may be provided with both a wired network interface and a wireless network interface without departing from the scope of the present disclosure. In some embodiments, the communication interface(s) 208, 216 may include different communications ports that interconnect with various input/output lines.

The first card reader 204 may be configured to read cards of a first type. For instance, the first card reader 204 may be configured to read the first card 132 or similar cards that operate with a similar protocol or utilize a similar data format. The second card reader 212 may be configured to read cards of a second type, which may be the same or different from the cards of the first type that are read by the first card reader 204. For instance, the second card reader 212 may be configured to read the second card 136 or similar cards that operate with a similar protocol or utilize a similar data format.

As will be discussed in further detail herein, the format or form factor of a card 132, 136 should not be limited to any particular type of format or form factor. Examples of suitable form factors that may be used for one or both of the first card 132 and second card 136 include, without limitation, magstripe cards, chip-based cards, contactless/wireless cards, key fobs, mobile communication devices, optically-readable cards, or the like. It should be appreciated that one or both of the cards 132, 136 may be capable of being read by a reader 204, 212 when brought within a predetermined distance of the reader 204, 212 (e.g., if the reader 204, 212 includes an antenna and is utilize a contactless communication protocol like Near Field Communications (NFC) or Bluetooth). Alternatively or additionally, one or both of the cards 132, 136 may be capable of being read by a reader 204, 212 when inserted to a slot of a card reader 204, 212 or swiped through a card reader 204, 212. To the extent that the form factor of a card 132, 136 can vary and is not limited, it should be appreciated that the first card reader 204 and/or second card reader 212 may be provided with any number of hardware and/or software components to enable interactions with a card 132, 136. More specifically, each reader 204, 212 may be provided with appropriate hardware and/or software components to enable the reader 204, 212 to extract/read data that is stored on a card 132, 136.

In some embodiments, when the first card reader 204 is used to read data from a first card 132, the data read from the first card 132 may be provided directly to the first communication interface 208. The first communication interface 208 may be configured to provide some or all of the data from the first card 132 directly to the first game management system 116 (e.g., without providing the data first to the processor 220). The first communication interface 208 may then provide some or all of the data from the first card 132 to the processor 220 or may inform the processor 220 of a card read event. In some embodiments, the first communication interface 208 may not necessarily provide any data from the first card 132 to the first game management system 116. Rather, upon reading data from the first card 132, the first communication interface 208 may automatically initiate a login process for the player 112 that presented the first card 132 to the first card reader 204. The login process may involve sending one or more communications to the first game management system 116, but such communications may not necessarily include data read from the first card 132.

In some embodiments, when the second card reader 212 is used to read data from a second card 136, the data read from the second card 136 may be provided to the processor 220. In response to the read event and in response to receiving the data read from the second card 136, the processor 220 may initiate a login process with the second game management system 124. The login process with the second game management system 124 may or may not include transmitting some or all of the data read from the second card 136 to the second game management system 124. As part of communicating with the second game management system 124, the processor 220 may utilize the second communication interface 216.

Figure 3:
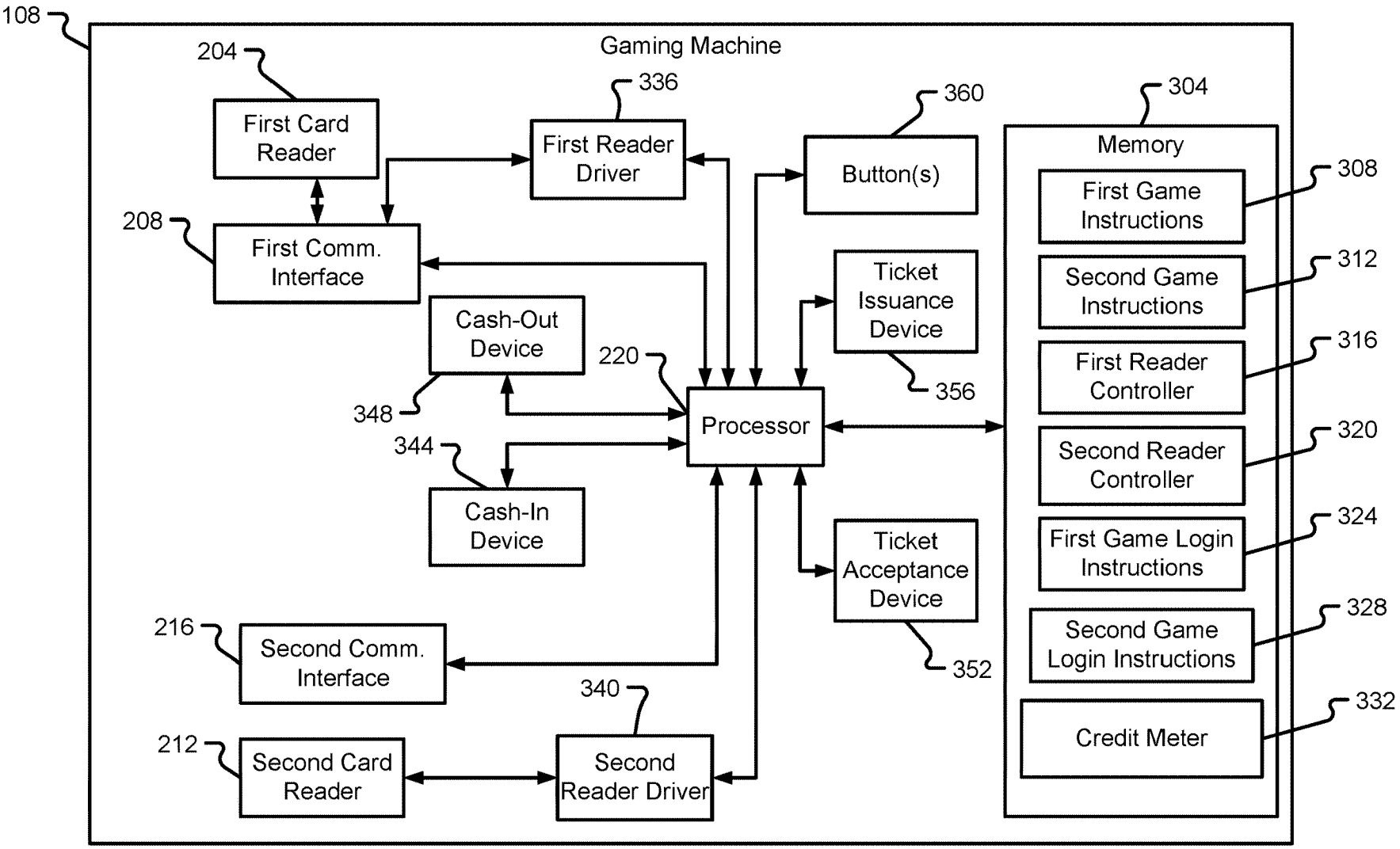
FIG. 3 is a block diagram depicting further details of a gaming machine in accordance with embodiments of the present disclosure.

With reference now to FIG. 3, additional components of a gaming machine 108 will be described in accordance with at least some embodiments of the present disclosure. The gaming machine 108 is shown to further include memory 304, a first reader driver 336, a second reader driver 340, a cash-in device 344, a cash-out device 348, a ticket acceptance device 352, a ticket issuance device 356, and one or more buttons 360.

The processor 220 may include one or multiple computer processing devices. In some embodiments, the processor 220 may include a microprocessor, a CPU, a microcontroller, or the like. The processor 220 may also be configured to execute one or more instruction sets stored in memory 304.

The memory 304 may include one or multiple computer memory devices that are volatile or non-volatile. The memory 304 may be configured to store instruction sets that enable player 112 interaction with the gaming machine 108, that enable the gaming machine 108 to interact with the first game management system 116, that enable the gaming machine 108 to interact with the second game management system 124, and that enable the gaming machine 108 to provide a player 112 with the ability to login to both the first game management system 116 and/or second game management system 124. Examples of instruction sets that may be stored in the memory 304 include a first game instruction set 308, a second game instruction set 312, a first reader controller 316, a second reader controller 320, a first game login instruction set 324, and a second game login instruction set 328. While the first reader controller 316 is depicted as being provided in memory 304, it should be appreciated that functionality of the first reader controller 316 may be provided in whole or in part by the first reader driver 336. Thus, the first reader controller 316 may be provided in the first reader driver 336 without departing from the scope of the present disclosure. Likewise, functionality of the second reader controller 320 may be provided in whole or in part by the second reader driver 340. The second reader controller 320 may be provided in the second reader driver 340 rather than being provided in memory 304. The controllers 316, 320 can be provided as software instructions, firmware instructions, combinations thereof, or the like.

The first game instruction set 308, when executed by the processor 220, may enable the gaming machine 108 to facilitate one or more games of chance or skill and produce interactions between the player 112 and the game of chance or skill. In some embodiments, the first game instruction set 308 may include subroutines that present one or more graphics to the player 112 via a user interface, subroutines that calculate whether a particular game wager has resulted in a win or loss during the game of chance or skill, subroutines for determining payouts for the player 112 in the event of a win, subroutines for exchanging communications with the first game management system 116 via the first communication interface 216, and any other subroutine or set of instructions that facilitate gameplay at or in association with the gaming machine 108.

Similarly, the second game instruction set 312, when executed by the processor 220, may enable the gaming machine 108 to present games or information to the player 112 on behalf of the second game management system 124. In some embodiments, the second game instruction set 312 may include instructions that enable the player 112 to place wagers on sporting events, watch live sporting events via the gaming machine 108, track a status of wagers placed on sporting events, track a status of events occurring in sporting events, and the like. In a situation where the second game management system 124 does not correspond to a sports wagering system, then the second game instruction set 312 may be configured to provide a game experience to the player 112 similar to the first game instruction set 308.

The first reader controller 316, when executed by the processor 220 and/or first reader driver 336, may enable functionality of the first card reader 204. In some embodiments, the first reader controller 316 may be configured to control the first card reader 204 to read data from a first card 132, register that a card read event has occurred at the first card reader 204, extract data from the first card 132 during a card read event, and perform other operations in connection with managing the first card reader 204. In some embodiments, where the first card reader 204 is integrated with the first communication interface 208, the first reader driver 336 may also be integrated with the first communication interface 208. Thus, functionality associated with the first card reader 204, the first reader controller 316, and/or the first reader driver 336 may be provided in the first communication interface 208, in whole or in part.

The second reader controller 320, when executed by the processor 220 and/or second reader driver 340, may enable functionality of the second card reader 212. In some embodiments, the second reader controller 320 may be configured to control the second card reader 212 to read data from a second card 136, register that a card read event has occurred at the second card reader 212, extract data from the second card 136 during a card read event, and perform other operations in connection with managing the second card reader 212.

The first game login instruction set 324, when executed by the processor 220 and/or first reader driver 336 and/or first communication interface 208, may enable the gaming machine 108 to initiate a login process for a player 112 with the first game management system 116. In some embodiments, the login process for the first game management system 116 may be initiated automatically in response to a card read event occurring at the first card reader 204. In some embodiments, the login process for the first game management system 116 may be initiated in response to registering a first card read event at the first card reader 204. Alternatively or additionally, the login process for the first game management system 116 may be initiated in response to reading data from the first card 132 and confirming a validity of the data read from the first card 132. As mentioned above, embodiments are contemplated where the login process for the first game management system 116 is initiated by the first communication interface 208 and without any intervention or assistance by the processor 220.

The second game login instruction set 328, when executed by the processor 220 and/or second reader driver 340 and/or second communication interface 216, may enable the gaming machine 108 to initiate a login process for a player 112 with the second game management system 124. In some embodiments, the login process for the second game management system 124 may be initiated automatically in response to a card read event occurring at the second card reader 212. In some embodiments, the login process for the second game management system 124 may be initiated in response to registering a second card read event at the second card reader 212. Alternatively or additionally, the login process for the second game management system 124 may be initiated in response to reading data from the second card 136 and confirming a validity of the data read from the second card 136.

The credit meter 332 may correspond to a device or collection of devices that facilitates a tracking of wager activity or available wager credits at the gaming machine 108. Such credits may be made available for wagers or bets placed on a game managed by the first game management system 116 and/or a game or event managed by the second game management system 124. In some embodiments, the credit meter 332 may be used to store or log information related to various player 112 activities and events that occur at the gaming machine 108. The types of information that may be maintained in the credit meter 332 include, without limitation, player information, available credit information, wager amount information, and other types of information that may or may not need to be recorded for purposes of accounting for wagers placed at the gaming machine 108 and payouts made for a player 112 during a game of chance or skill played at the gaming machine 108. In some embodiments, the credit meter 332 may be configured to track coin-in activity, coin-out activity, coin-drop activity, jackpot paid activity, bonus paid activity, credits applied activity, external bonus payout activity, ticket/voucher in activity, ticket/voucher out activity, timing of events that occur at the gaming machine 108, and the like. Some or all of the data within the credit meter 332 may be reported to the first game management system 116 and/or second game management system 124. As an example, the number, value, and timing of wagers placed by a particular player 112 and payouts on such wagers may be reported.

The cash-in device 344 may include a bill acceptor, a coin acceptor, a chip acceptor or reader, or the like. In some embodiments, the cash-in device 344 may also include credit card reader hardware and/or software. The cash-out device 348 may operate and issue cash, coins, tokens, or chips based on an amount indicated within the credit meter 332. In some embodiments, the cash-out device 348 may include a coin tray or the like and counting hardware configured to count and distribute an appropriate amount of coins or tokens based on a player's 112 winnings or available credit within the credit meter 332.

The gaming machine 108 may also be provided with a ticket acceptance device 352 that is configured to accept or scan physically-printed tickets/vouchers and extract appropriate information therefrom. In some embodiments, the ticket acceptance device 352 may include one or more machine vision devices (e.g., a camera, IR scanner, optical scanner, barcode scanner, etc.), a physical ticket acceptor, a shredder, etc. The ticket acceptance device 352 may be configured to accept physical tickets and/or electronic tickets without departing from the scope of the present disclosure. An electronic ticket/voucher may be accepted by scanning a one-dimensional barcode, two-dimensional barcode, or other type of barcode or quick response (QR) code displayed by a player's 112 mobile communication device 144, for example.

The ticket issuance device 356 may be configured to print or provide physical tickets/vouchers to players 112. In some embodiments, the ticket issuance device 356 may be configured to issue a ticket/voucher consistent with an amount of credit available to a player 112, possibly as indicated within the credit meter 332.

The button(s) 360 may correspond to any type of mechanical or software-based input device. In some embodiments, the button(s) 360 may be provided on a common panel or portion of the gaming machine 108 and may be used to initiate a predetermined function in response to being pressed by the player 112. A button 360, as can be appreciated, may alternatively or additionally take the form of one or more depressible buttons, a lever or "one armed bandit handle," etc. A button 360 may include one or more mechanically-actuatable components or may correspond to a predetermined area of a display that is configured to receive a user input.

Figure 4:
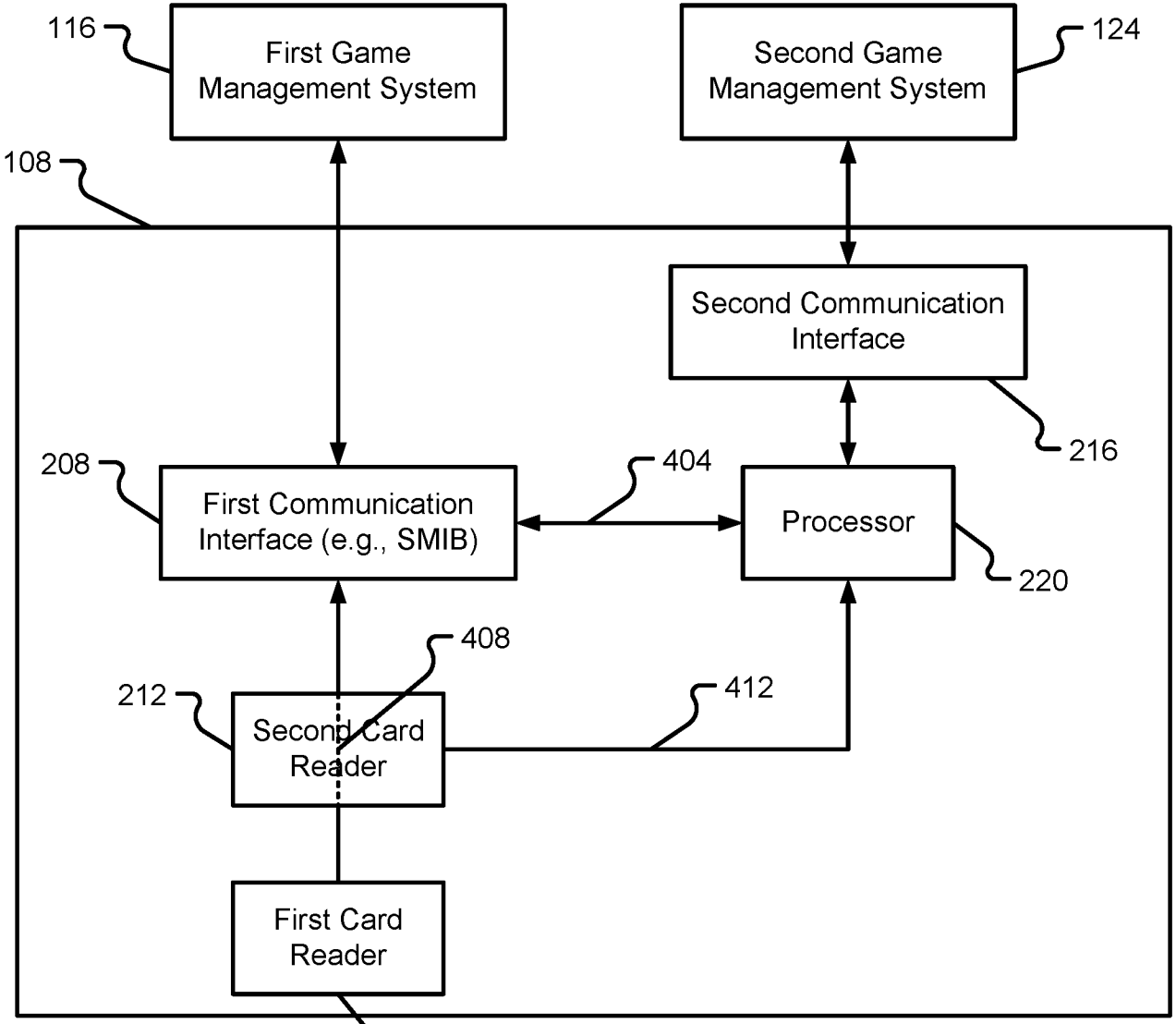
FIG. 4 is a block diagram depicting an illustrative gaming machine configuration in accordance with embodiments of the present disclosure.

FIG. 4 illustrates a possible configuration of components in the gaming machine 108 in accordance with at least some embodiments of the present disclosure. This particular configuration illustrates that the first card reader 204 is used to read data from a card (e.g., a first card 132 and/or second card 136). The data read from the card is passed to the first communication interface 208, which may be in the form of a SMIB. The second reader 212 is provided with a tap 408 to the data communications between the first card reader 204 and first communication interface 208. The data read by the second card reader 212 using the tap 408 may be forwarded along to the processor 412 whereas the data received at the first communication interface 208 may cause the first communication interface 208 to initiate a login process with the first game management system 116. In this particular embodiment, the card data read from the first card reader 204 may be the same as the card data read by the second card reader 212, which means that the player 112 may only be required to present a single card to the gaming machine 108 to initiate a login process with both the first game management system 116 and the second game management system 124. In this particular configuration, the second card reader 212 acts to publish card-in/card-out messages to the processor 220. When the processor 220 receives the card data from the second card reader 212, the processor 220 may initiate a login process for the player 112 with respect to the second game management system 124. This login process for the first game management system 116 may occur in parallel with the login process for the second game management system 124 and both login processes may be triggered by the same card read event at the first card reader 204.

FIG. 4 further illustrates that the first communication interface 208 may share at least some data with the processor 220 using an appropriate communication protocol. In some embodiments, a SAS protocol 404 is used to exchange data (e.g., card data, card read event data, status information, etc.) between the first communication interface 208 and the processor 220.

Figure 5:
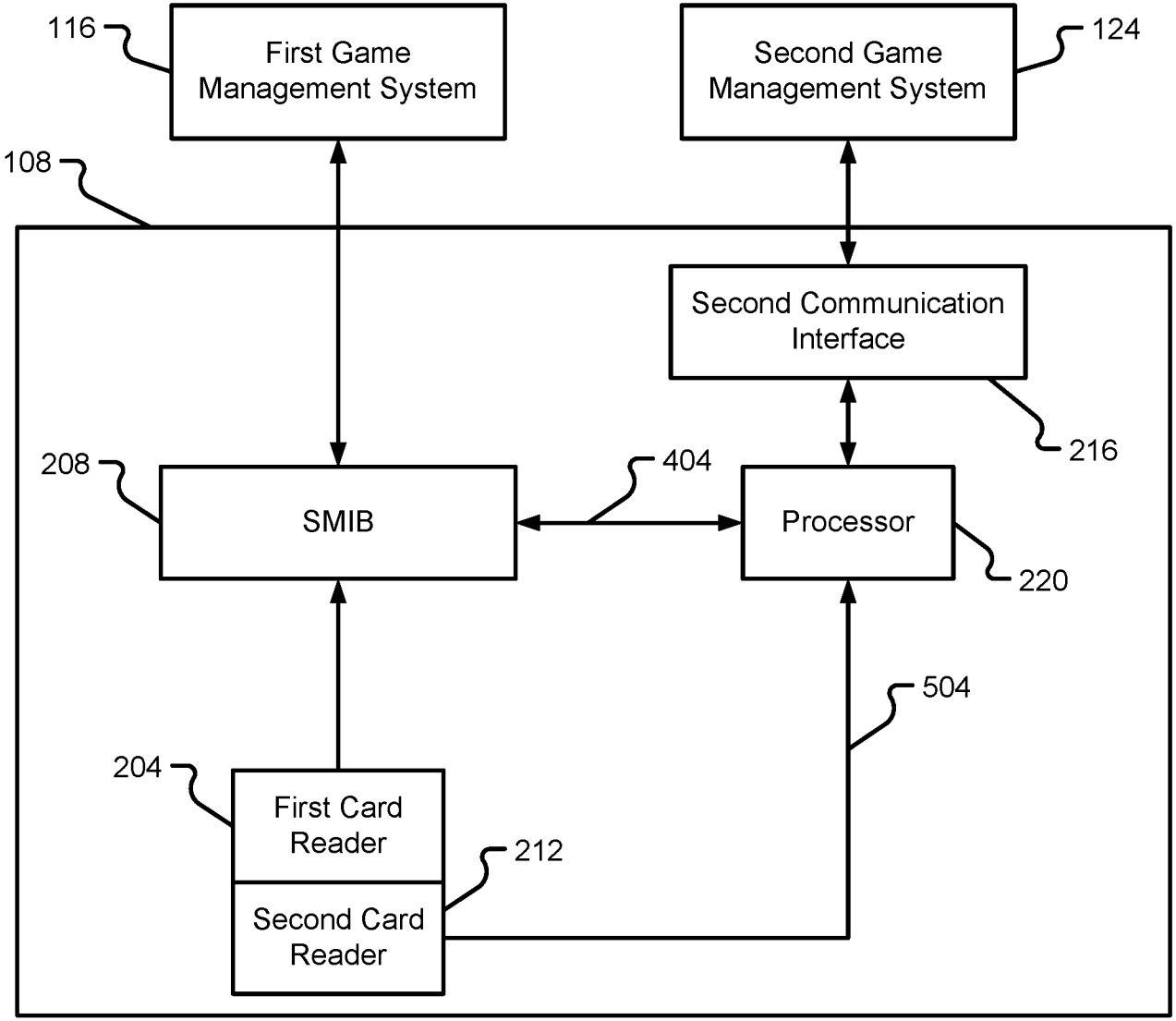
FIG. 5 is a block diagram depicting another illustrative gaming machine configuration in accordance with embodiments of the present disclosure.

FIG. 5 illustrates another possible configuration of components in the gaming machine 108 in accordance with at least some embodiments of the present disclosure. This particular configuration may be similar to the configuration of FIG. 4, but the second card reader 212 is now provided as a skimmer that performs a card read of a card while the card is being presented, inserted, or swiped through the first card reader 204. As an example, if the first card reader 204 comprises a magstripe or chip-based card reader, then the second card reader 212 may be positioned relative to the first card reader 204 such that a player 112 is forced to present their card to the first card reader 204 by also passing the card into contact with the second card reader 212. When the first card reader 204 reads the data from the card, the appropriate data may be provided to the first communication interface (e.g., SMIB) 208, which may cause the SMIB to automatically initiate a login process with the first game management system 116. Likewise, when the second card reader 212 reads data from the card as the card is being passed through the second card reader 212, the second card reader 212 may provide the data to the processor 220 via a wire or trace 504.

Upon receiving the data from the second card reader 212, the processor 220 may initiate a player 112 login process with the second game management system 124.

Figure 6A:
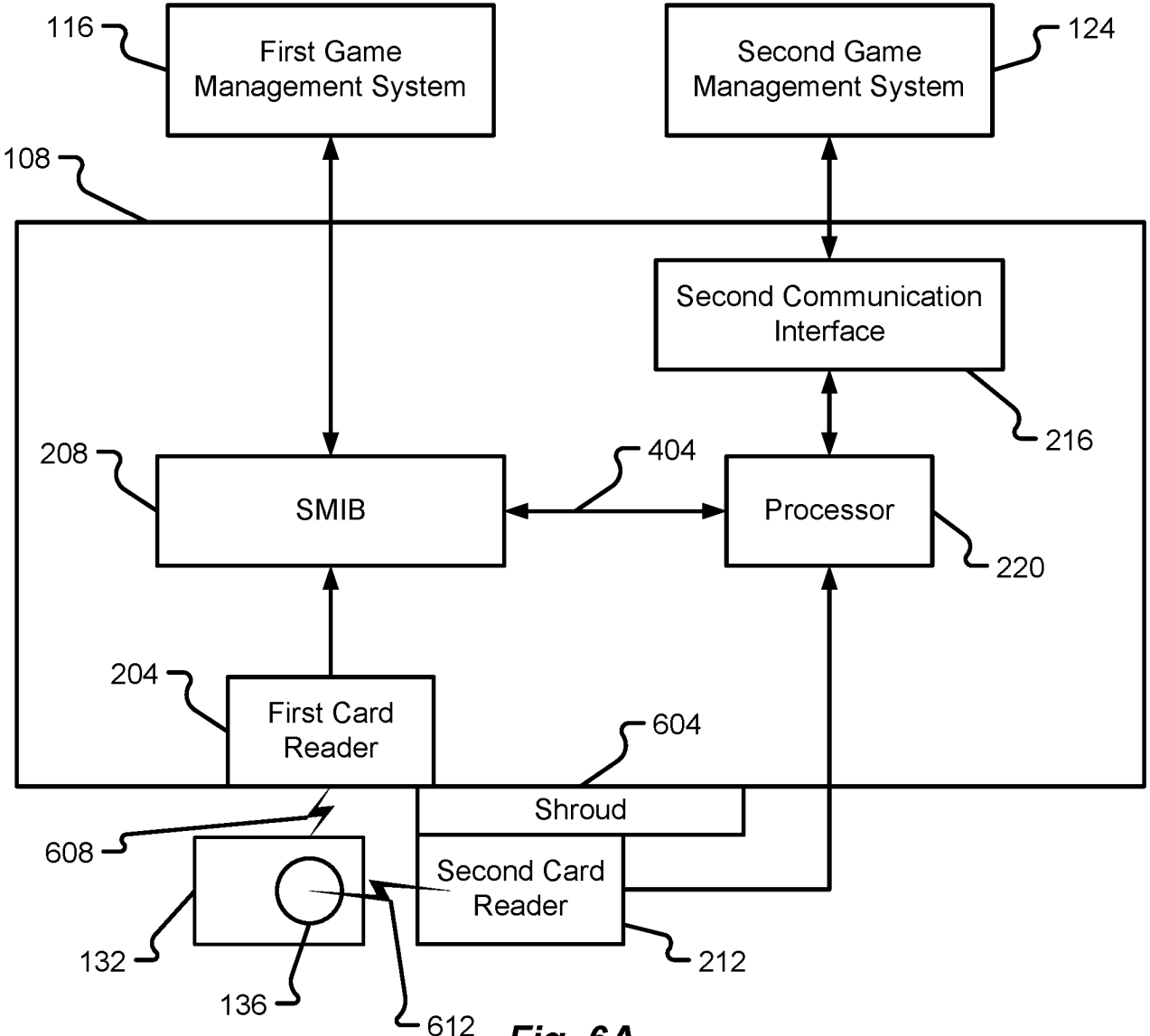
FIG. 6A is a block diagram depicting yet another illustrative gaming machine configuration in accordance with embodiments of the present disclosure.
Figure 6B:
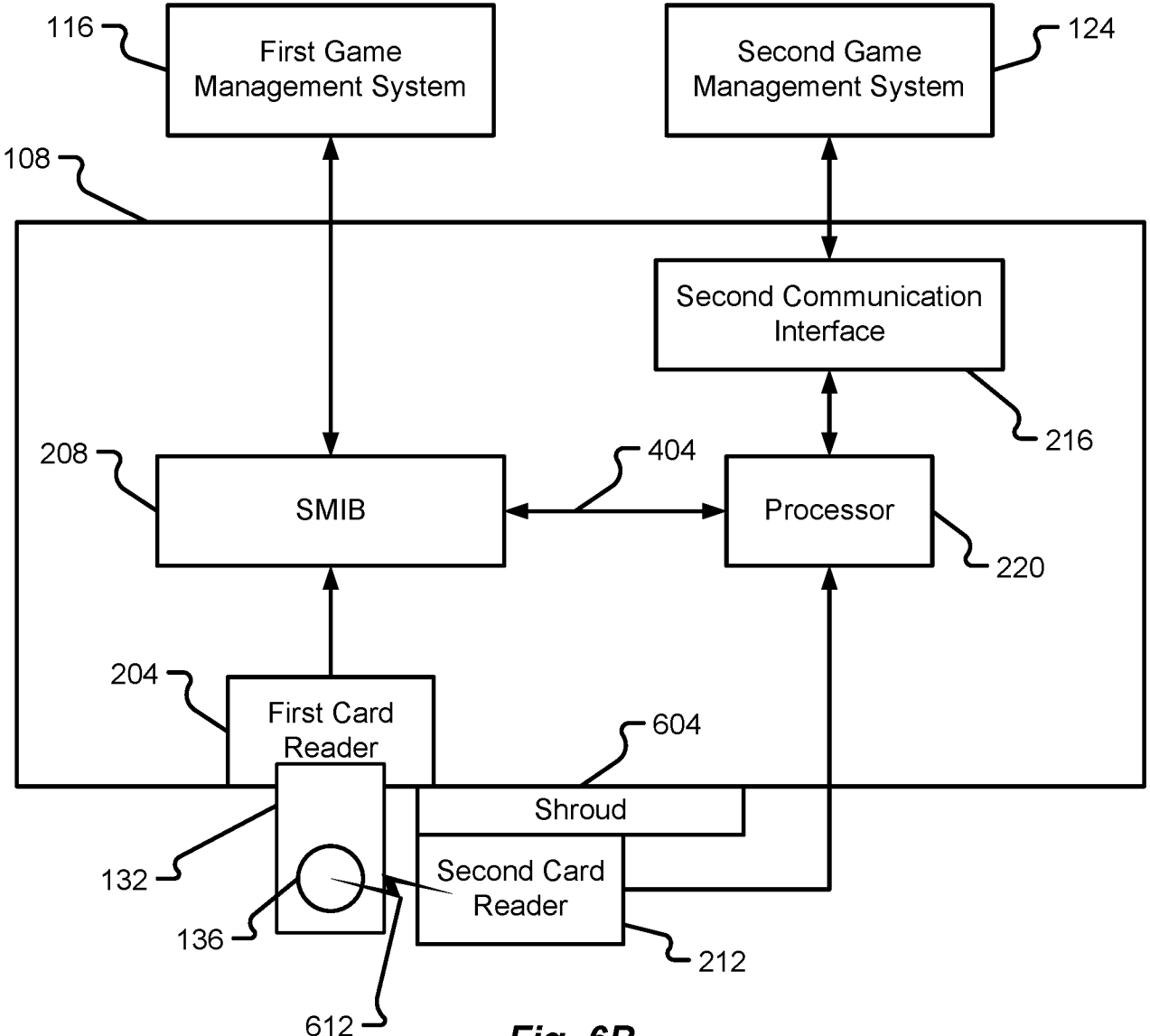
FIG. 6B is a block diagram depicting still another illustrative gaming machine configuration in accordance with embodiments of the present disclosure.

Referring now to FIGS. 6A and 6B, still another possible configuration of a gaming machine 108 will be described in accordance with at least some embodiments of the present disclosure. These particular configurations illustrate that the second card reader 212 may be placed in close physical proximity with the first card reader 204 such that if a single form factor is provided with both the first card 132 and second card 136, then the first card reader 204 is enabled to read data from the first card 132 while the second card reader 212 is enabled to read data from the second card 136. The configuration of FIG. 6A illustrates a situation where both the first card reader 204 and second card reader 212 include antennas and read data from the card 132, 136 via a contactless or wireless communication protocol. Examples of suitable protocols that may be used in this configuration include, without limitation, NFC, Bluetooth (e.g., BLE), WiFi, or the like. The relative position of the first card reader 204 and second card reader 212 may depend upon the communication range of the protocol used by the first card reader 204 and second card reader 212. For example, if both card readers 204, 212 utilize NFC, then the second card reader 212 may need to be placed closer to the first card reader 204 than if the card readers 204, 212 were utilizing BLE, which has a longer communication range than NFC.

In the event that the first card reader 204 and second card reader 212 need to be placed within 10 cm or less, then the second card reader 212 may be provided on a shroud 604 or the like that is positioned adjacent to the first card reader 204. Positioning the second card reader 212 in this way may enable the first card reader 204 to establish a first wireless communication link 608 with the first card 132 while the second card reader 212 simultaneously establishes a second wireless communication link 612 with the second card 136. In some embodiments, the second card 136 may correspond to an NFC sticker or the like that is physically attached or adhered to the first card 132. It should be appreciated that this particular configuration of the gaming machine 108 may be suitable for a situation where the first card 132 corresponds to a mobile communication device (e.g., a smartphone or the like) and the second card 136 either corresponds to the mobile communication device or an NFC sticker adhered to the mobile communication device.

FIG. 6B illustrates an alternative configuration where the first card reader 204 requires contact with the first card 132 to read data therefrom whereas the second card reader 212 is configured to read data from the second card 136 while the first card 132 is inserted or swiped through the first card reader 204. In other words, the second card reader 212 is positioned relative to the first card reader 204 such that when the first card 132 is placed into contact with the first card reader 204, the second card 136 is brought within a communication range of the second card reader 212 such that the second wireless communication link 612 can be established between the second card reader 212 and the second card 136.

Figure 7:
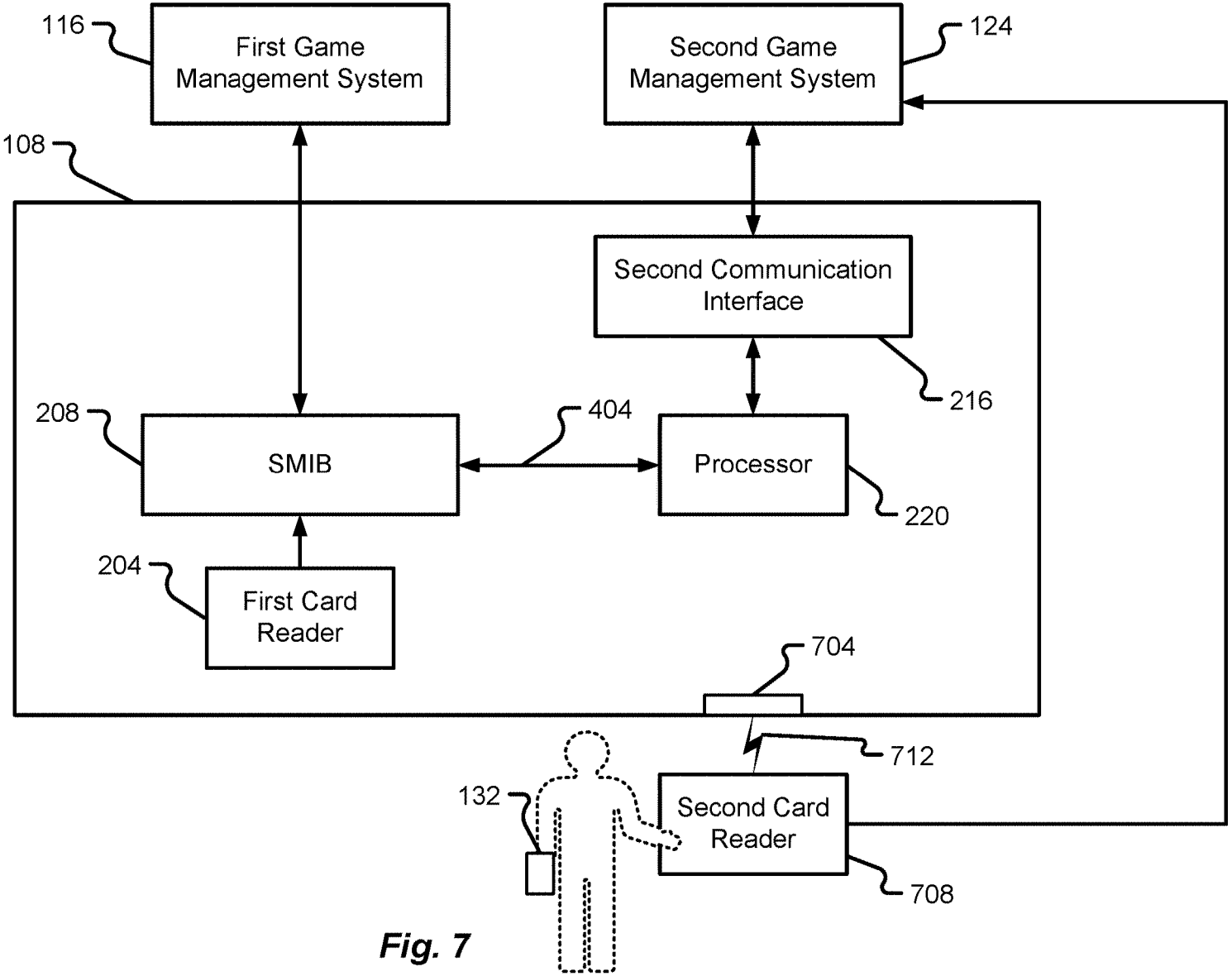
FIG. 7 is a block diagram depicting another illustrative gaming machine configuration in accordance with embodiments of the present disclosure.

FIG. 7 illustrates still another possible configuration where the second card reader 708 is now provided separate from the gaming machine 108, but is still used to initiate a player 112 login with the second game management system 124. This particular configuration contemplates that the second card reader 708 may correspond to a mobile communication device (e.g., smartphone) that is carried by the player 112 and is capable of establishing a wireless communication link 712 with a tag 704 provided on the gaming machine 108. When the second card reader 708 reads data from the tag 704, some of the data read from the tag 704 may cause the second card reader 708 to initiate communications with the second game management system 124 or server therein. Specifically, the second card reader 708 may read data from the tag 704 in an NFC Data Encryption Format (NDEF) that includes a URL or web address that resolves to a server of the second game management system 124. The URL may also include an identification of the gaming machine 108. When the communication is established between the second game management system 124 and the second card reader 708, the second card reader 708 may also provide player ID data to the second game management system 124, thereby enabling the player 112 to login with the second game management system 124. In this particular configuration, the player 112 may still present the first card 132 to the first card reader 204 to initiate a login process with the first game management system 116.

Methods

Figure 8:
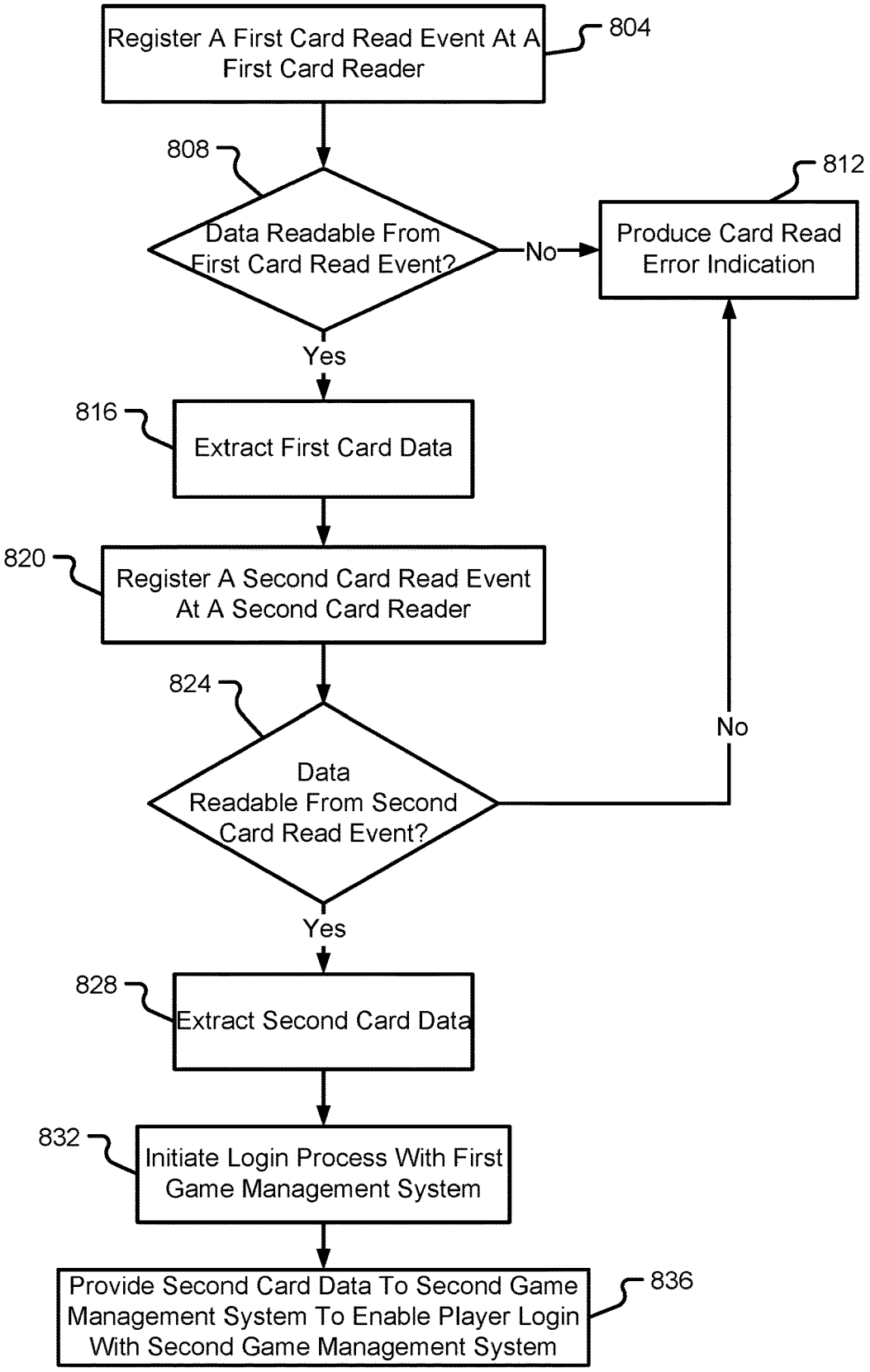
FIG. 8 is a flow diagram depicting a first method in accordance with embodiments of the present disclosure.
Figure 9:
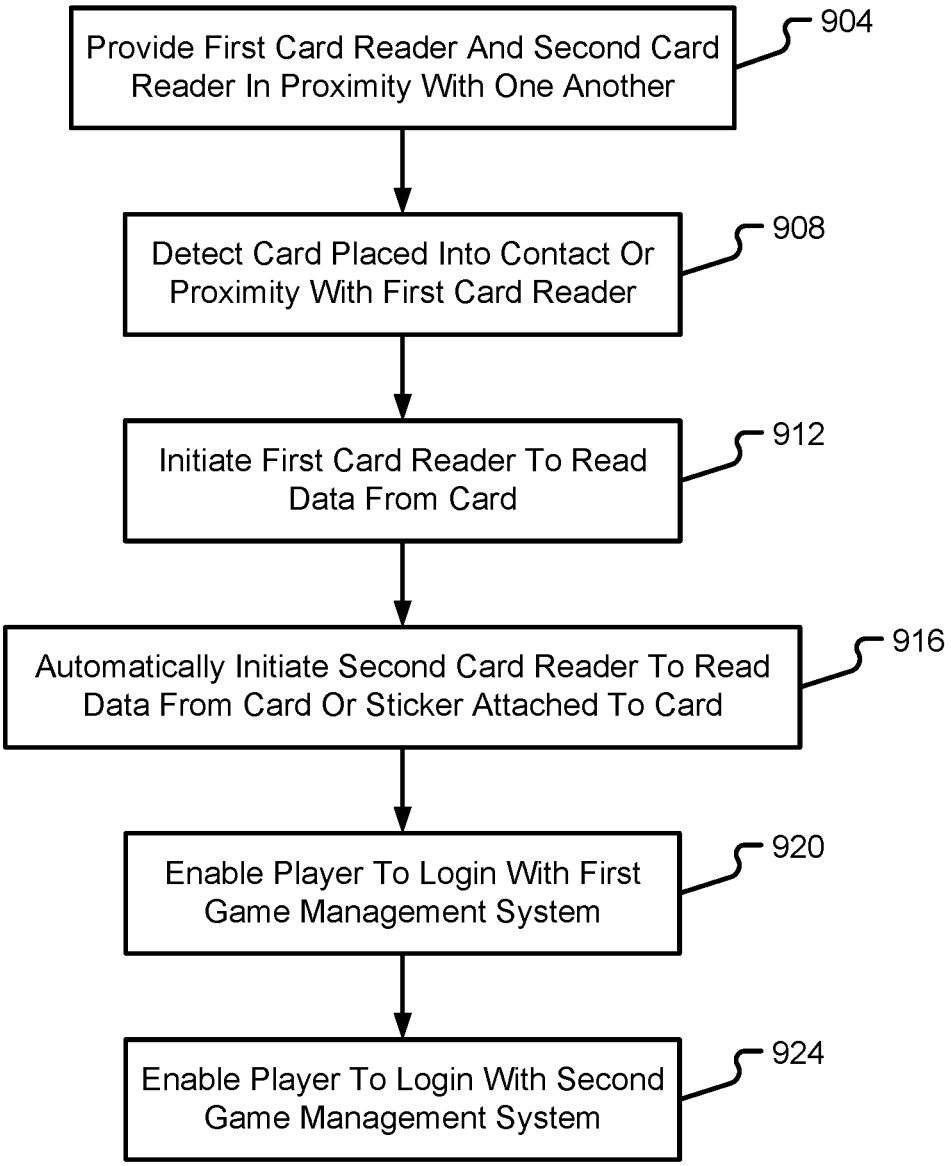
FIG. 9 is a flow diagram depicting a second method in accordance with embodiments of the present disclosure.

With reference now to FIGS. 8-9, various methods will be described in accordance with at least some embodiments of the present disclosure. It should be appreciated that the disclosed methods may be performed by one, some, or all of the devices depicted and described herein. Said another way, any device within the system 100 may be used to perform some or all of a method depicted and described herein. Moreover, although certain steps are depicted as being performed in a certain order or in connection with a particular method, it should be appreciated that any method step depicted and described herein may be performed in combination with any other method step depicted and described herein.

Referring initially to FIG. 8, a first method of enabling a player 112 to interact with multiple game management systems will be described in accordance with at least some embodiments of the present disclosure. The method begins by registering a first card read event at a first card reader 204 (step 804). Registration of the first card read event may correspond to sensing a presence of a first card 132 in proximity with the first card reader 204 and then initiating a card read process with the first card reader 204. Alternatively or additionally, registration of the first card read event may correspond to detecting insertion or swiping of a first card 132 into the first card reader 204. This may also be referred to as detecting a card-in event at the first card reader 204. Alternatively or additionally, registration of the first card read event may correspond to detecting the establishment of a first wireless communication link 608 and/or detecting a pairing between a first card 132 and the first card reader 204.

The method continues by determining whether data is readable during this first card read event (step 808). If the data is not readable from the card, then the method may continue with the gaming machine 108 producing a card read error indication (step 812). The card read error indication may including sounding a buzzer, flashing a light, or otherwise providing a player 112 with an indication that data cannot be read from the card presented to the first card reader 204.

If, however, the first reader 204 is able to read data from the card presented thereto, then the method may continue with the first card reader 204 extracting data from the card (step 816). In some embodiments, the first card reader 204 may be considered to be extracting data from the first card 132 consistent with the protocol defined for the first card 132 and first card reader 204. In some embodiments, the data read from the first card 132 may include a first player identification number that is in a first player identification number format. The first player identification number format may correspond to a format required or used by the first game management system 116. Specifically, the first player identification number format may correspond to a format used to store data in the first database 120 within the player ID field 148.

The method may then continue by registering a second card read event at a second card reader 212 (step 820). Registration of the second card read event may be similar to registration of the first card read event, but with reference to activity at the second card reader 212. The method may then continue by determining whether the data from the second card read event is readable (step 824). If not, then the method continues by producing a card read error message (step 812).

If, however, the data from the second card read event is also readable, then the method will continue with the second card reader 212 extracting data from the card (step 828). In some embodiments, the second card reader 212 may be considered to be extracting data from the second card 136 consistent with the protocol defined for the second card 136 and second card reader 212. In some embodiments, the data read from the second card 136 may include a second player identification number that is in a second player identification number format. The second player identification number format may correspond to a format required or used by the second game management system 124. Specifically, the second player identification number format may correspond to a format used to store data in the second database 128 within the player ID field 148. It should be appreciated that the first player identification number format may be different from the second player identification number format; however, it may be possible that the first player identification number format may be the same as the second player identification number format. It should also be appreciated that steps 804, 808, and 812 may be performed serially or in parallel with steps 820, 824, and 828.

The method may then continue with the first communication interface 208 initiating a login process with the first game management system 116 (step 832). In some embodiments, the login process with the first game management system 116 may be initiated automatically and in response to registering the first card read event. The login process may or may not require the gaming machine 108 to share the data read from the first card with the first game management system 116.

The method may also continue with the processor 220 utilizing the second communication interface 216 to initiate a login process with the second game management system 124 (step 836). In some embodiments, the login process with the second game management system 124 may also be initiated in response to registering the second card read event. The login process may or may not involve providing data read from the second card 126 to the second game management system 124 to enable the player 112 to login with the second game management system 124. It should be appreciated that due to the nature of the first game management system 116 as compared with the second game management system 124, the gaming machine 108 may login the player 112 with the first game management system 116 without providing the first player identification number to the first game management system 116, but the gaming machine 108 may login the player 112 with the second game management system 124 by providing the second player identification number to the second game management system 124.

With reference now to FIG. 9, a second method of enabling a player 112 to interact with multiple game management systems will be described in accordance with at least some embodiments of the present disclosure. The method begins by providing a first card reader 204 and a second card reader 212 within a predetermined proximity of one another (step 904). In some embodiments, a predetermined proximity may correspond to a communication range used by the first card reader 204 and/or second card reader 212 to wirelessly read data from a card.

The method continues by detecting a presence of a card placed into contact or proximity with the first card reader 204 (step 908). This may initiate the first card reader 204 to read data from the card (step 912). Because the first card reader 204 and second card reader 212 are within the predetermined proximity of one another, the method may proceed by automatically initiating the second card reader 212 to read data from the card or from an NFC sticker attached to the card (step 912).

The data read by the first card reader 204 may enable the player 112 carrying the card to login with the first game management system 116 (step 920). Meanwhile, the data read by the second card reader 212 may enable the player 112 carrying the card to login with the second game management system 124 (step 924).

Other embodiments are also envisioned. For instance, an embodiment is contemplated where a a single magstripe card is used and the player 112 is allowed to insert the card into the first card reader 204 and then the same card into the second card reader 212. The system would be configured to not log the player out when removing the card from the first card reader 204 immediately. Instead, the player 112 may only be logged out after some timeout (e.g., a predetermined amount of time has passed and the player 112 has not inserted the card into some other card reader), after some time of not using the second card reader 212, or while there is money on the gaming machine 108. The magstripe on the card may be configured with multiple tracks so the first card reader 208 could use one track and the second card reader 212 could use the same or a different track. It should be appreciated that using the same track would involve multiple systems utilizing the same id/number to recognize the player 112. After being logged into both systems 116, 124 if the player 112 were to remove the card the gaming machine 108 may be configured to optionally log out of both systems 116, 124. Alternatively or additionally, the player 112 may be offered a manual "log out" button that, when pressed, would log the player 112 out of both systems 116, 124. Such a feature may also apply to logging a player 112 out of one or both systems 116, 124. A possible embodiment contemplated enables the player 112 to log out of one system (e.g., the first game management system 116) using one device and then the gaming machine 108 would automatically initiate a process of logging the player 112 out of the other system 124. Continuing this example, if the magstripe card is also provided with the NFC/Bluetooth, then when the player 112 removes the physical card, the player 112 may be automatically logged out of both systems 116, 124.

The present disclosure contemplates a variety of different gaming systems and environments each having one or more of a plurality of different features, attributes, or characteristics. A "gaming system" or "gaming environment" as used herein refers to various configurations of: (a) one or more central servers, central controllers, or remote hosts; (b) one or more electronic gaming machines such as those located on a casino floor; and/or (c) one or more gaming devices, such as desktop computers, laptop computers, tablet computers or computing devices, personal digital assistants, mobile phones, and other mobile computing devices. Moreover, an Electronic Gaming Machine (EGM) as used herein refers to any suitable electronic gaming machine which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk, such as a sports betting kiosk.

In various embodiments, the gaming system of the present disclosure includes: (a) one or more electronic gaming machines in combination with one or more central servers, central controllers, or remote hosts; (b) one or more gaming devices in combination with one or more central servers, central controllers, or remote hosts; (c) one or more gaming devices in combination with one or more electronic gaming machines; (d) one or more gaming devices, one or more electronic gaming machines, and one or more central servers, central controllers, or remote hosts in combination with one another; (e) a single electronic gaming machine; (f) a plurality of electronic gaming machines in combination with one another; (g) a single gaming device; (h) a plurality of gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "gaming device" as used herein represents one gaming device or a plurality of gaming devices and, in some embodiments, may include an EGM or multiple EGMs. The use of "server, central server, central controller, or remote host" as used herein represents one central server, central controller, or remote host or a plurality of central servers, central controllers, or remote hosts.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM in combination with a central server, central controller, or remote host, the central server, central controller, or remote host is any suitable computing device (such as a server) that includes at least one processor and at least one memory device or data storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM. Further, one, more than one, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a communication network, the communication network may include a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a communication network, the communication network may include a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. In certain embodiments in which the communication network includes a WAN, the gaming system includes a central server, central controller, or remote host and an EGM each located in a different gaming establishment in a same geographic area, such as a same city or a same state. Gaming systems in which the communication network includes a WAN are substantially identical to gaming systems in which the communication network includes a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a communication network, the communication network may include an internet (such as the Internet) or an intranet. In certain such embodiments, an Internet browser of the EGM is usable to access an Internet game page from any location where an Internet connection is available. In one such embodiment, after the EGM accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM, such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. An electronic gaming machine, comprising:

a first communication interface that enables communications via a first communication protocol with a first game management system, wherein the first game management system tracks first player activity;

a second communication interface that enables communications via a second communication protocol with a second game management system, wherein the second game management system tracks second player activity;

a first card reader;

a second card reader;

a processor coupled to the first card reader, the second card reader, the first communication interface, and the second communication interface; and a computer memory device, coupled with the processor and comprising instructions stored thereon that are executable by the processor, wherein the instructions comprise instructions that:

register a first card read event at the first card reader and, in response to registering the first card read event, extract first card data that includes a first player identification number in a first player identification number format;

register a second card read event at the second card reader and, in response to registering the second card read event, extract second card data that includes a second player identification number in a second player identification number format;

enable a player to login to the first game management system in response to registering the first card read event; and provide the second card data to the second communication interface to enable the player to login to the second game management system.

2. The electronic gaming machine of claim 1, wherein the first player identification number format is different from the second player identification number format, wherein the first communication interface comprises a Slot Machine Interface Board (SMIB), and wherein the SMIB communicates with the processor using a Slot Accounting System (SAS) protocol.

3. The electronic gaming machine of claim 2, wherein the first game management system comprises a casino game management system and wherein the second game management system comprises a sports wagering system.

4. The electronic gaming machine of claim 3, wherein the instructions that register the first card read event detect a physical card being inserted into the first card reader and wherein the instructions that register the second card read event detect a credential being placed into a predetermined proximity of the second card reader.

5. The electronic gaming machine of claim 4, wherein the second card reader comprises an antenna that communicates wirelessly with the credential and wherein the second card reader is placed relative to the first card reader such that placement of the credential adjacent to the first card reader places the credential within the predetermined proximity of the second card reader, thereby enabling the second card reader to wirelessly communicate with the credential.

6. The electronic gaming machine of claim 5, wherein the second card reader utilizes a Near Field Communications (NFC) protocol to wirelessly communicate with the credential and wherein the credential comprises an NFC sticker that is attached to the physical card.

7. The electronic gaming machine of claim 6, further comprising a shroud that is positioned adjacent to the first card reader, wherein the second card reader is positioned on the shroud.

8. The electronic gaming machine of claim 5, wherein the second card reader utilizes a Bluetooth protocol to communicate with the credential and wherein the credential comprises a mobile communication device.

9. The electronic gaming machine of claim 2, wherein the SMIB communicates directly with the first game management system to enable the player to login with the first game management system and wherein the SMIB provides a copy of the first player identification number to the processor after the player is logged in with the first game management system.

10. The electronic gaming machine of claim 1, wherein the first card reader reads the first card data using a first protocol, wherein the second card reader reads the second card data using a second protocol different from the first protocol, wherein the first card read event is different from the second card read event, and wherein the second protocol comprises a contactless communication protocol.

11. A system, comprising:

a first game management system that tracks first player activity;

a second game management system that tracks second player activity; and an electronic gaming machine that communicates with the first game management system and the second game management system, wherein the electronic gaming machine comprises:

a first communication interface that enables communications with the first game management system;

a second communication interface that enables communications with the second game management system;

a first card reader;

a second card reader;

a processor coupled to the first card reader, the second card reader, the first communication interface, and the second communication interface; and a computer memory device, coupled with the processor and comprising instructions stored thereon that are executable by the processor, wherein the instructions comprise instructions that:

receive first card data from the first card reader that includes a first player identification number in a first player identification number format;

receive second card data from the second card reader that includes a second player identification number in a second player identification number format;

enable a player to login to the first game management system in response to receiving the first card data; and provide the second card data to the second communication interface to enable the player to login to the second game management system.

12. The system of claim 11, wherein the first player identification number format is different from the second player identification number format, wherein the first communication interface comprises a Slot Machine Interface Board (SMIB), and wherein the SMIB communicates with the processor using a Slot Accounting System (SAS) protocol.

13. The system of claim 12, wherein the second game management system comprises a sports wagering system, the system further comprising:

a sports wagering database that is used by the sports wagering system to store player identification numbers in the second player identification number format in association with sports wager information.

14. The system of claim 13, wherein the instructions further comprise instructions that:

register a first card read event at the first card reader; and register a second card read event at the second card reader, wherein the first card read event is different from the second card read event.

15. The system of claim 14, wherein the instructions that register the first card read event detect a physical card being inserted into the first card reader and wherein the instructions that register the second card read event detect a credential being placed into a predetermined proximity of the second card reader.

16. The system of claim 15, wherein the credential is physically attached to the physical card, wherein the first card reader reads the physical card using a contact-based communication protocol, and wherein the second card reader reads the credential using a contactless communication protocol while the first card reader is reading the physical card.

17. A method of operating an electronic gaming machine, the method comprising:

registering a first card read event at a first card reader;

in response to registering the first card read event, extracting, with a processor, first card data that includes a first player identification number in a first player identification number format;

registering a second card read event at a second card reader;

in response to registering the second card read event at the second card reader, extracting, with the processor, second card data that includes a second player identification number in a second player identification number format;

enabling, with the processor, a player to login to a first game management system, wherein the first game management system tracks a first player activity; and providing, with the processor, the second card data to a second communication interface to enable the player to login to a second game management system, wherein the second game management system tracks a second player activity using the second player identification number format.

18. The method of claim 17, wherein the first player identification number format is different from the second player identification number format, wherein the player is enabled to login to the first game management system via a first communication interface that comprises a Slot Machine Interface Board (SMIB), wherein the SMIB communicates with the processor using a Slot Accounting System (SAS) protocol, wherein the first player activity comprises a first login event of the player with the first game management system via the electronic gaming machine, and wherein the second player activity comprises a second login event of the player with the second game management system via the electronic gaming machine.

19. The method of claim 17, wherein the first card reader reads the first card data using a first protocol, wherein the second card reader reads the second card data using a second protocol different from the first protocol, wherein the first card read event is different from the second card read event, and wherein the second protocol comprises a contactless communication protocol.

20. The method of claim 19, wherein the contactless communication protocol comprises a maximum communication distance of a predetermined proximity, the method further comprising:

providing the second card reader adjacent to the first card reader such that a card placed into contact with the first card reader is simultaneously within the predetermined proximity of the second card reader.

* * * * *